US005799933A

United States Patent [19]

Yang

[11] Patent Number: 5,799,933

[45] Date of Patent: Sep. 1, 1998

[54] ADJUSTABLE CLAMPING JAW FOR A VISE

[76] Inventor: Tai-Her Yang, No. 32 Lane 29, Taipin St., Si-Hu Town Dzan-Hwa, Taiwan

[21] Appl. No.: 699,354

[22] Filed: Aug. 19, 1996

[51] Int. Cl.[6] ..... B25B 1/24

[52] U.S. Cl. ..... 269/261; 269/258; 269/265

[58] Field of Search ..... 269/258–262, 269/268, 271, 265, 156, 152

[56] References Cited

U.S. PATENT DOCUMENTS 4,834,354 5/1989 Yang ..... 269/258

4,969,638 11/1990 Yang ..... 269/258

*Primary Examiner*—Robert C. Watson

*Attorney, Agent, or Firm*—Bacon & Thomas

[57] ABSTRACT

The design is related to that the existing integral upper plate of the movable clamp with step end type servo-action vise may cause interference for the thin plate work piece, whereby the separated upper plates are designed to expand the clamp's applicability in utilizing its end steps to clasp the work piece, and an indenture is further provided at the jaw structure of the movable clamp to extend its applicable range of clasping.

2 Claims, 3 Drawing Sheets

ADJUSTABLE CLAMPING JAW FOR A VISE

SUMMARY OF THE INVENTION

The design is related to that the existing integral upper plate of the movable clamp with step end type servo-action vise may cause interference for the thin plate work piece, whereby the separated upper plates are designed to expand the clamp's applicability in utilizing its end steps to clasp the work piece, and an indenture is further provided at the jaw structure of the movable clamp to extend its applicable range of clasping.

DETAILED DESCRIPTION OF THE INVENTION

The application of the conventional servo-action vise is limited due to that the installed integral upper plate for limiting the movable step-end semi-half circular clamps and the jaw structure between the two movable semi-half circular clamps may cause interference for work piece with small intersected angle; thereof the, design is related to that the existing integral upper plate of the movable clamp with stop end type servo-action vise may cause interference for the thin plate work piece, whereby the separated upper plates are designed to expand the clamp's applicability in utilizing its end steps to clasp the work piece, and an indenture is further provided at the jaw structure of the movable clamp to extend its applicable range of clasping.

Figure 1:
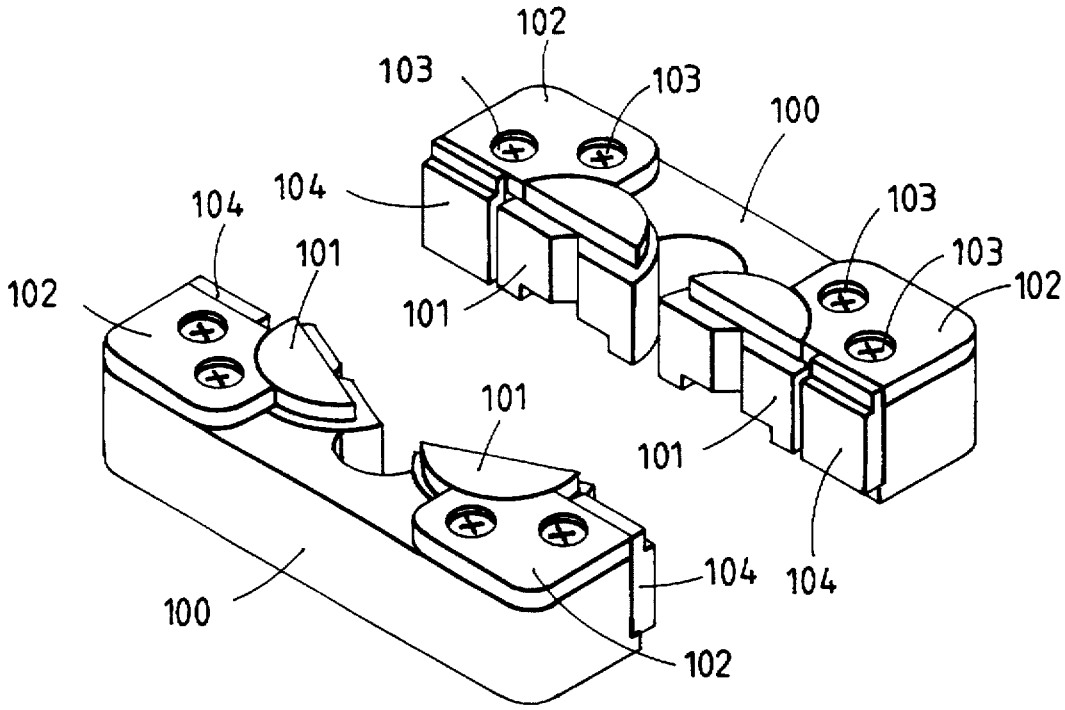
FIG. 1 is an embodying example of the movable step-end clamp type servo-action vise with the separated upper plates and the jaw end face.

As is well-known, the servo-action vise is comprised of clamp machine base, fixed jaw, slide jaw, movable step-end clamp and the driving mechanism to drive the clamps for mutual forced clasping or release, whereof one or two of the corresponding jaw ends are each installed with two movable clamps, and each clamp appear in half circular or semi-half circular structure with upper end step inward retreated, whereby the holding step is for clasping the work piece, and the semi-half circular step is for coupling with the limiting upper plate to fix the clamp downward from the top; thereof FIG. 1 is an embodying example of the movable step-end clamp type servo-action vise with the separated upper plates and the jaw end face, wherein it is mainly comprised of the jaw structure 100 for installing with two movable semi-half circular clamps 101 at the middle and two flat clamps 104 at the two ends, whereof the limiting upper plates 102 are installed on the top of two ends, wherein the upper plate is fixed on the jaw structure 100 by the screw 103 to limit the movable semi-half circular clamps 101 to swivel without falling, wherein it is mainly characterized in the following:

Each movable semi-half circular clamp has its individually independent upper plate, whereof it is characterized that the neighboring independent upper plates are spatially separated for easy clasping the abnormal shaped thin plate type work piece.

Figure 2:
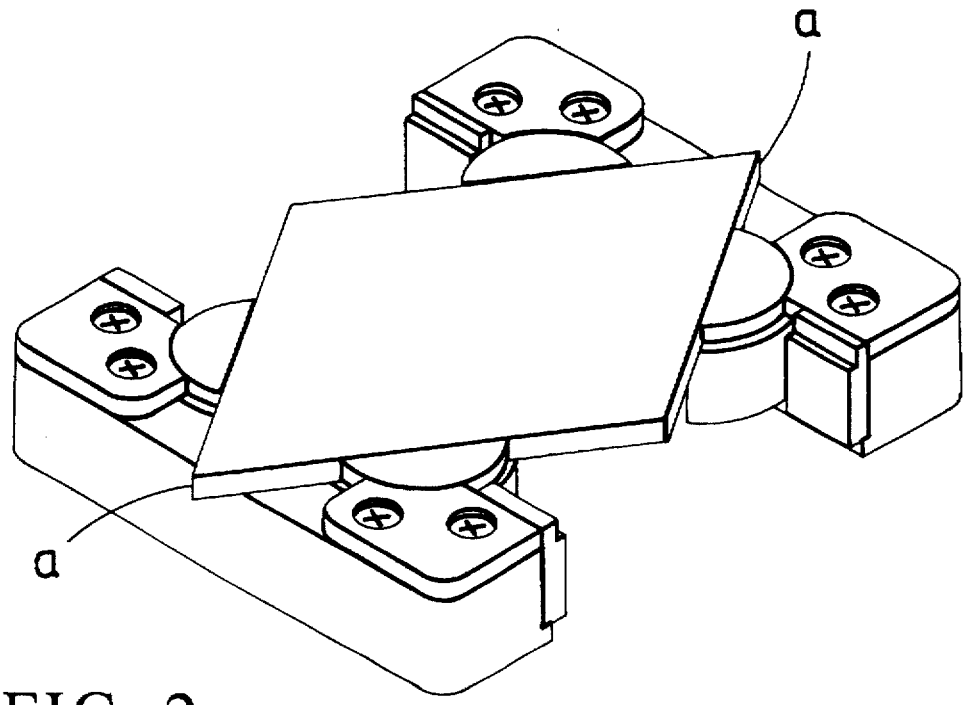
FIG. 2 is a clasping application example of FIG. 1.

FIG. 2 is a clasping application example of FIG. 1, wherein the sharp angle "a" of the work piece in FIG. 2 can be extended without hindering the holding.

Figure 3:
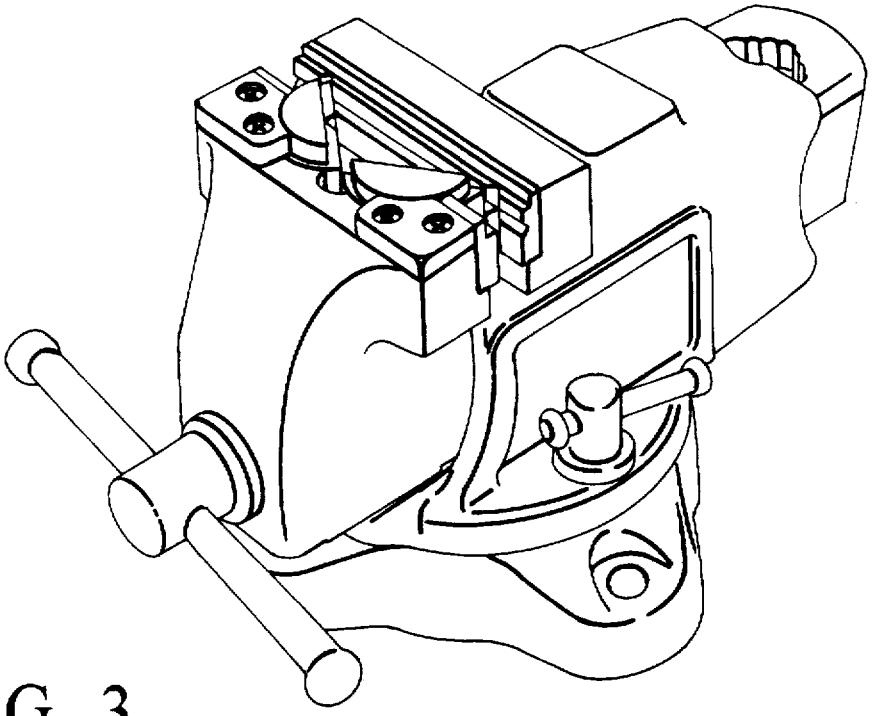
FIG. 3 is an embodying example of the invention on the bench vise application.

FIG. 3 is an embodying example of the invention on the bench vise application. The movable step-end clamp type servo-action vise with separated upper plates as described by the design includes the corresponding clasping structure comprised of two or more than two identical structures, or comprised of the jaw structure constituted by the separated end upper plates structure of the movable step-end clamp type servo-action vise to match with the flat clamp type jaw, or the step-end flat clamp type jaw.

FIG. 3 is an embodying example of the invention on the bench vise application.

Figure 4:
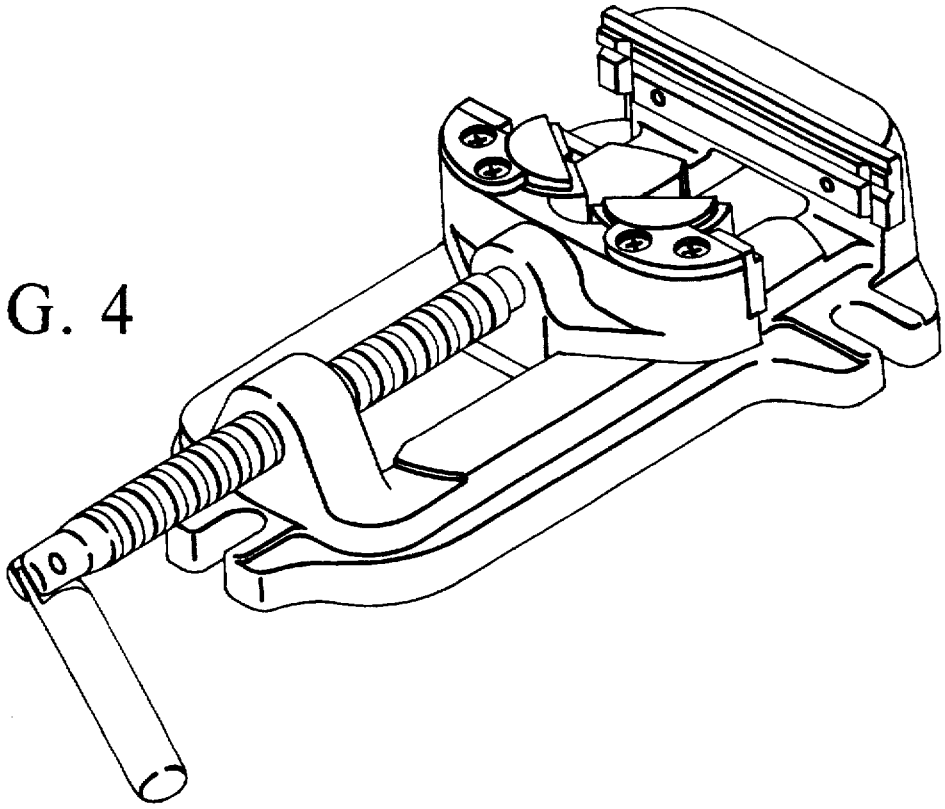
FIG. 4 is an embodying example of the invention on the drilling machine vise application.

FIG. 4 is an embodying example of the invention on the drilling machine vise application.

Figure 5:
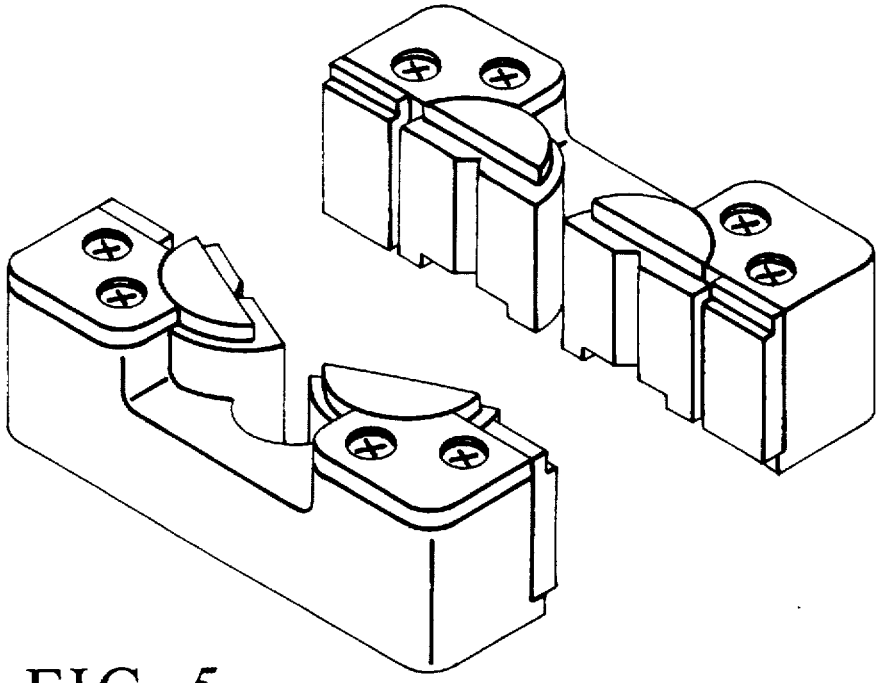
FIG. 5 is an embodying example illustrating the downward indenture between the two movable step-end semi-half circular clamps.

In addition, the disclosed improvements on the separated upper plates and the jaw end face of the movable step-end clamps type servo-action vise can be further designed to have a downward indenture on the jaw structure between the two semi-half circular clamps; wherein the downward extended indenture includes the application on the non-end-step type movable semi-half circular clamps;

FIG. 5 is an embodying example illustrating the downward indenture between the two movable step-end semi-half circular clamps to further enlarge the work piece space, wherein the design is also applicable on the non-end-step type movable semi-half circular clamps.

Figure 6:
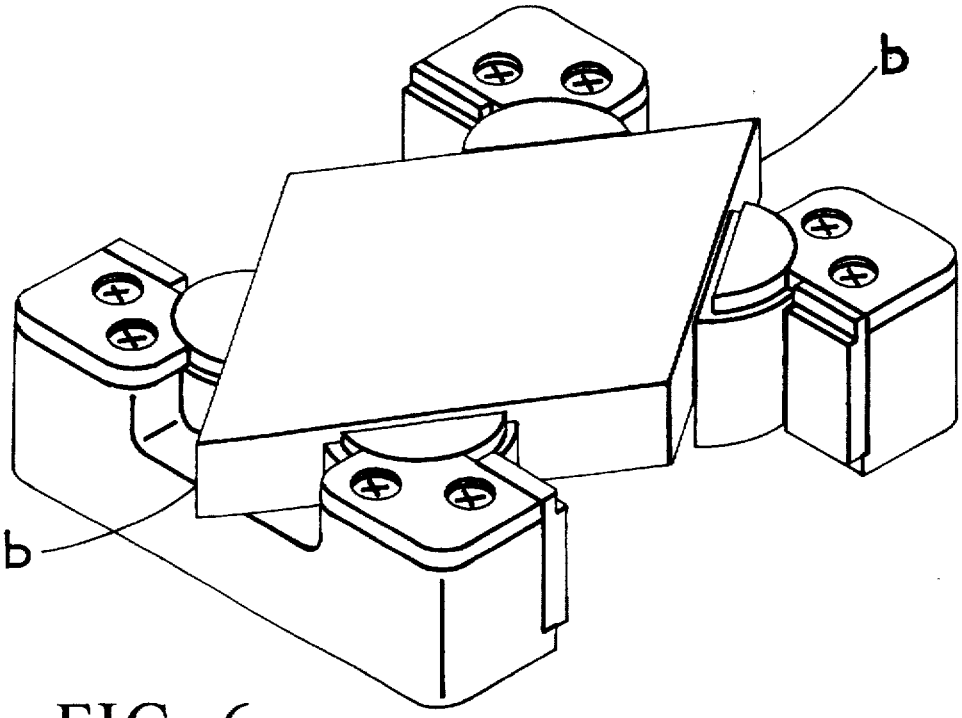
FIG. 6 is a clasping application example of FIG. 5.

FIG. 6 is a clasping application example of FIG. 5, wherein the sharp angle "b" can be extended without hindering the holding.

As summarized from the above descriptions, the removable end-step clamps type servo-action vise with separated end upper plates and the jaw end face is by the separated end limiting upper plates structure and downward indenture installed between the two movable semi-half circular clamps of the jaw structure to let the servo-action vise further increase the adapting space for the abnormal shape work piece, whereby as the invention is innovative with practical functions, your approval by law is greatly appreciated.

I claim:

1. An adjustable clamping jaw for a vice, comprising:

a) a jaw member having an upper surface;

b) a pair of semi-cylindrical spaced apart clamping members located on the jaw member, each clamping member having a clamping surface extending above the upper surface of the jaw member; and, c) two plates attached to the upper surface of the jaw member, each plate in contact with one of the pair of clamping members so as to attach the clamping members to the jaw member such that each clamping member pivots with respect to the jaw member, a distance between the two spaced apart plates being greater than a distance between adjacent portions of the spaced apart clamping members whereby a workpiece clamped between the pair of clamping members may extend between the two plates and over the upper surface of the jaw member.

2. The adjustable clamping jaw of claim 1 further comprising an indentation in the upper surface of the jaw member extending between the two spaced apart plates.

* * * * *